US006571853B1

(12) United States Patent
Ciuca et al.

(10) Patent No.: US 6,571,853 B1
(45) Date of Patent: Jun. 3, 2003

(54) CORDLESS BLIND HAVING VARIABLE RESISTANCE TO MOVEMENT

(75) Inventors: Zazu Ciuca, Gamstown, NC (US); Roger Palmer, Greensboro, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 221 days.

(21) Appl. No.: 09/611,328

(22) Filed: Jul. 6, 2000

(51) Int. Cl.[7] ..... E06B 9/30
(52) U.S. Cl. ..... 160/170 R; 160/192
(58) Field of Search ..... 160/170 R, 171 R, 160/168.1 R, 172 R, 84.04, 84.05, 84.02, 191, 192, 193, 8, 296; 185/37, 39, 45

(56) References Cited

U.S. PATENT DOCUMENTS

| | | | |
|---|---|---|---|
| 13,251 | A | 7/1855 | Bixler |
| 322,732 | A | 7/1885 | Lang |
| 842,401 | A | 1/1907 | Goodell |
| 927,090 | A | 7/1909 | Anderson |
| 948,239 | A | 1/1910 | McManus |
| 1,636,601 | A | 7/1927 | Givens |
| 1,669,255 | A | 5/1928 | Landry |
| 1,721,501 | A | 7/1929 | McKee |
| 1,731,124 | A | 10/1929 | Carper |
| 1,789,655 | A | 1/1931 | Iwata |
| 1,951,659 | A | 2/1934 | Kesner |
| 2,037,393 | A | 4/1936 | Roberts |
| 2,049,518 | A | 8/1936 | Schier |
| 2,110,983 | A | 3/1938 | Carver |
| 2,175,549 | A | 10/1939 | Nardulli et al. |
| 2,250,106 | A | 7/1941 | Lorentzen |
| 2,260,101 | A | 10/1941 | De Falco |
| 2,266,160 | A | 12/1941 | Burns |
| 2,276,716 | A | 3/1942 | Cardona |
| 2,324,536 | A | 7/1943 | Pratt |
| 2,325,992 | A | 8/1943 | Wirthman |
| 2,350,094 | A | 5/1944 | Butts |
| 2,390,826 | A | 12/1945 | Cohn |
| 2,410,549 | A | 11/1946 | Olson |
| 2,420,301 | A | 5/1947 | Cusumano |
| 2,509,033 | A | 5/1950 | Carver |
| 2,520,629 | A | 8/1950 | Esposito |
| 2,535,751 | A | 12/1950 | Nardulli |
| 2,598,887 | A | 6/1952 | Burns |
| 2,609,193 | A | 9/1952 | Foster |
| 2,687,769 | A | 8/1954 | Gershuny |
| 2,824,608 | A | 2/1958 | Etten |
| 2,874,612 | A | 2/1959 | Luboshez |
| 3,141,497 | A | 7/1964 | Griesser |

(List continued on next page.)

FOREIGN PATENT DOCUMENTS

| | | |
|---|---|---|
| EP | 0 796 994 A2 | 9/1997 |
| FR | 883 709 | 7/1943 |
| FR | 2 337 809 | 8/1977 |

OTHER PUBLICATIONS

F.A. Votta, The Theory and Design of Long–Deflection Constant–Force Spring Elements, Transactions of the Asme, May 1952, pp. 439–450.

*Primary Examiner*—David M. Purol
(74) *Attorney, Agent, or Firm*—Marshall, Gerstein & Borun

(57) ABSTRACT

A cordless blind having a mechanism for introducing a variable amount of friction into the operation of the cordless blind is disclosed. The cordless blind includes a spring motor operatively connected to a cord connected to the window covering of the blind. Pulling and releasing the cord expands and retracts the blind. In order to introduce additional resistance to movement into the system when retracting the blind and not when expanding the blind, variable friction mechanisms or retarders, including one-way bearings, and one-way braking arms, are used for introducing friction into the system only when desired.

33 Claims, 5 Drawing Sheets

U.S. PATENT DOCUMENTS 3,371,700 A 3/1968 Romano
3,485,285 A 12/1969 Anderle
3,487,875 A 1/1970 Shukat et al.
3,756,585 A 9/1973 Mihalcheon
3,817,309 A 6/1974 Takazawa
4,157,108 A 6/1979 Donofrio
4,205,816 A 6/1980 Yu
4,223,714 A 9/1980 Weinreich et al.
4,326,577 A 4/1982 Tse
4,344,474 A 8/1982 Berman
4,398,585 A 8/1983 Marlow
4,574,864 A 3/1986 Tse
4,610,292 A 9/1986 Hausmann et al.
4,623,012 A 11/1986 Rude et al.
4,625,786 A 12/1986 Carter et al.
4,647,488 A 3/1987 Schnebly et al.
4,726,410 A 2/1988 Fresh
4,852,627 A 8/1989 Peterson et al.
4,856,574 A 8/1989 Minami et al.
4,862,941 A 9/1989 Colson
4,877,075 A 10/1989 Markowitz
4,880,045 A 11/1989 Stahler
4,955,421 A 9/1990 Torti
4,984,617 A 1/1991 Corey
5,054,162 A 10/1991 Rogers
5,083,598 A 1/1992 Schön
5,103,888 A 4/1992 Nakamura
5,133,399 A 7/1992 Hiller et al.
5,141,041 A 8/1992 Katz et al.
5,157,808 A 10/1992 Sterner, Jr.
5,170,830 A * 12/1992 Coslett ..... 160/84.04
5,184,660 A 2/1993 Jelic
5,228,491 A 7/1993 Rude et al.
5,313,998 A 5/1994 Colson et al.
5,318,090 A 6/1994 Chen
5,363,898 A 11/1994 Sprague
5,391,967 A 2/1995 Domel et al.
5,413,161 A 5/1995 Corazzini
5,482,100 A 1/1996 Kuhar
5,485,875 A 1/1996 Genova
5,531,257 A 7/1996 Kuhar
5,706,876 A 1/1998 Lysyj
5,813,447 A 9/1998 Lysyj
6,012,506 A * 1/2000 Wang et al. ..... 160/170
6,056,036 A * 5/2000 Todd et al. ..... 160/84.05
6,234,236 B1 * 5/2001 Kuhar ..... 160/84.05 X

* cited by examiner

CORDLESS BLIND HAVING VARIABLE RESISTANCE TO MOVEMENT

FIELD OF THE INVENTION

The present invention generally relates to window coverings and, more particularly, relates to cordless blinds and shades.

BACKGROUND OF THE INVENTION

A variety of window covering devices currently exist, including retractable shades and venetian blinds. In conventional venetian blinds, a plurality of slats are supported in ladder cords that extend between a head rail and a bottom rail. One or more take-up cords extend from the bottom rail, through the slats, and out of the head rail. Upward force on the take-up cords lifts the bottom rail towards the head rail, gathering the slats, from the lowermost to the uppermost.

In such blinds, the take-up cords are manually-operated. More specifically, the take-up cords which extend from the bottom rail, through the slats, and out of the head rail are drawn upon by a user which thereby lifts the bottom rail and hence the slats. A lock is typically provided to secure the take-up cord so that the blinds may be secured at various positions between a lowered, extended position, and a raised, fully retracted, position.

More recently, in cordless blind products, a spring motor has been provided that is coupled to a take-up drum to which the take-up cord is secured. The spring motor provides a lifting force to the take-up cord. Such spring motors provide smooth operation of the blind, and avoid lengthy cords extending from the blind which can be unsightly and become tangled thereby inhibiting operation of the blind.

With a cordless blind product, balancing of the spring motor force is difficult. As the blind is extended, the slats become supported by the ladder cords, and the weight supported by the spring motor reduces. Conversely, when the blind is retracted, the weight of the bottom rail and all the slats needs to be supported by the spring motor. Unless a spring motor provides a corresponding variable force, a number of problems may occur. For example, if the spring motor does not provide enough lifting force, the blind may not remain in the fully retracted position and may slowly fall downward. If the spring motor provides too much lifting force, the blind may not remain at an extended position, and the blind may slowly creep upward.

In practice, constant force spring motors sized to support the expected full weight of the slats may be used and an external mechanism, such as a clutch, may be used to lock the spring motor when the blind is at the desired location. However, such devices typically do not provide smooth operation.

Variable force spring motors have therefore been developed and permit the blind to be extended to virtually any position from fully retracted to fully extended. Still, sizing the spring motor is difficult. The variable force can be generated by using a spring member tapered in width, thickness and/or diameter which thus results in a force curve having its greatest force when the blind is retracted, and its lowest force when the blind is extended. Depending on the size and weight of the slats and bottom rail, the spring motor can be sized accordingly, or multiple spring motors may be used.

Even with such variables force spring motors, the introduction of friction to the system can be advantageous. Such additional friction creates a wider acceptable operational range for a given size of spring motor. However, if too much friction is added to the system, operation of the spring motor and blind will not be smooth. Moreover, it is desirable for the friction to be added only when the blind is being retracted and for little or no additional friction to be added when the blind is extended.

SUMMARY OF THE INVENTION

In accordance with one aspect of the invention, a window shade is provided which comprises an expandable covering, the covering being movable in a first direction when expanding to cover a window, the covering being movable in a second direction when retracting away from the window, a spring motor operably connected to the expandable covering to move the covering in the second direction, a rotating output connected to the spring motor, and a retarder associated with the rotating output, the retarder introducing resistance to movement of the covering in the second direction while not introducing resistance to movement of the covering in the first direction.

In accordance with other aspects of the invention, the retarder includes a one-way bearing or a brake.

In accordance with another aspect of the invention, a blind is provided which comprises an expandable covering, the covering being movable in a first direction when expanding, and in a second direction when retracting, a cord connected to the expandable covering, the cord being movable in a first direction when the covering is retracted and in a second direction when the covering is expanded, a spring motor connected to the cord for moving the covering between the retracted position and the expanded position, and a one-way roller in engagement with the cord for adding resistance to the movement of the cord in the first direction.

In accordance with another aspect of the invention, a blind is provided comprising an expandable covering, the covering being movable in a first direction when expanding and in a second direction when retracting, a cord connected to the expandable covering, a cord spool connected to the cord, a spring motor connected to the cord spool by a rotatable shaft, and a brake adapted to impart a first force against the shaft when the expandable covering moves in the first direction, and a second, higher, force when the expandable covering moves in the second direction.

In accordance with yet another aspect of the invention, a spring motor assembly is provide including a frame, a take-up drum pivotally mounted to the frame, a drive drum pivotally mounted to the frame, a coil spring interconnected between the take-up drum and the drive drum, a rotating member operatively connected to the drive drum, and a retarder associated with the rotating member. The retarder introduces resistance to the rotating member in a first direction of rotation and not in a second direction of rotation.

These and other aspects and features of the invention will become more apparent from the following detailed description when taken in conjunction with the accompanying drawings.

Figure 1:
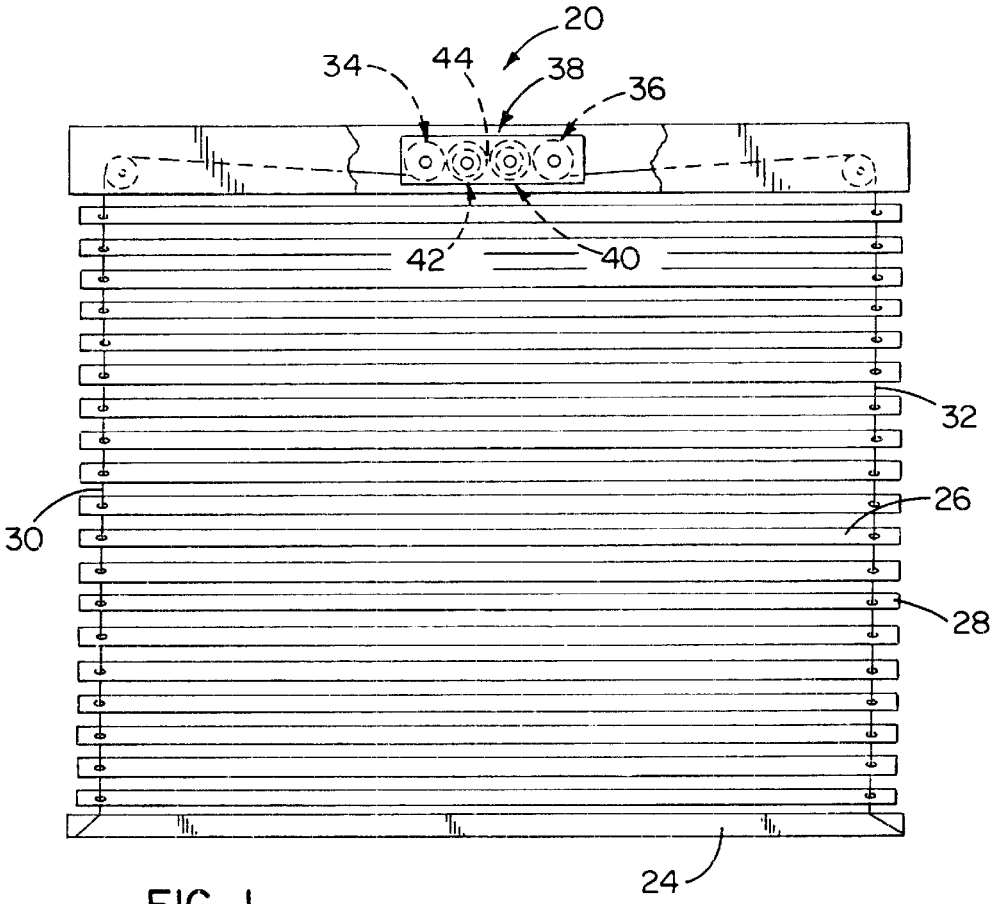
FIG. 1 is a front view of a blind according to the invention.

While the invention is susceptible of various modifications and alternative constructions, certain illustrative embodiments thereof have been shown in the drawings and will described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENTS

Referring now to the drawings and with specific reference to FIG. 1, a blind or shade according to the invention is generally depicted by reference numeral 20. As shown therein, the blind 20 includes a head rail 22, a bottom rail 24, and a window covering material 26 therebetween. In the depicted embodiment, the window covering 26 includes a plurality of slats 28, but other material, fabrics, and structures may be utilized.

In order to raise and lower the bottom rail 24 and slats 28, and thus move the blind 20 between a retracted upper position and a lowered extended position, the slats 28 are supported by first and second ladder cords forming a series of continuous loops (not shown), and first and second take-up cords 30, 32 extend through the slats 28 and connect the base rail 24 to the first and second cord spools 34 and 36. Rotation of the first and second cord spools 34 and 36 winds and unwinds the first and second take-up cords 30, 32 respectively thereon, and thus raises and lowers the blind 20. As opposed to conventional venetian blinds which extend the take-up cords from the head rail 22 for manually raising and lowering the blind 20, a cordless blind such as that depicted, includes a spring motor 38 to provide the motive force for raising the blind 20.

Figure 2:
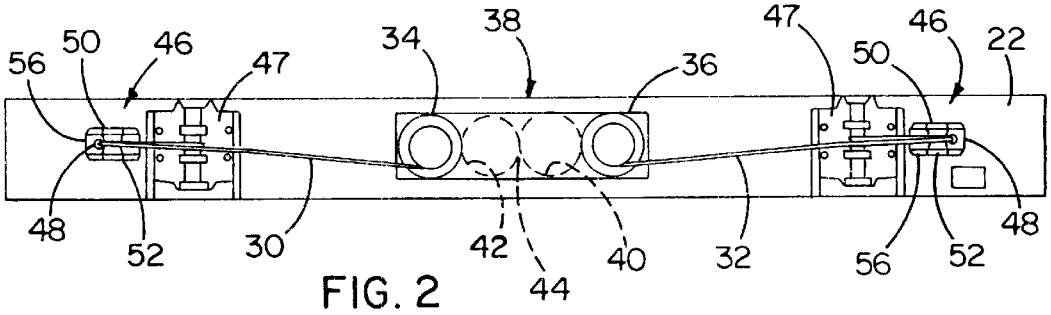
FIG. 2 is a top view of FIG. 1.

More specifically, as shown in FIG. 2, the spring motor 38 includes a take-up drum 40 and a drive drum 42 which are connected by a spring member 44. The spring member 44 is a coil spring in the form of a ribbon of metal pre-stressed on one side to thus cause the spring member 44 to have a natural or relaxed state in the form of a wound coil. The spring member 44 is wound onto the take-up drum 40 in its relaxed state, and connected to the drive drum 42 such that upon rotation of the drive drum 42, the spring member 44 is back wound onto the drive drum 42. Thus, when the drive drum 42 rotates and back winds the spring member 44 onto the drive drum, the spring member 44 is biased to rewind back on to the take-up drum 40. It is this biasing force which is utilized by the blind 20 to raise the window covering 26.

Figure 3:
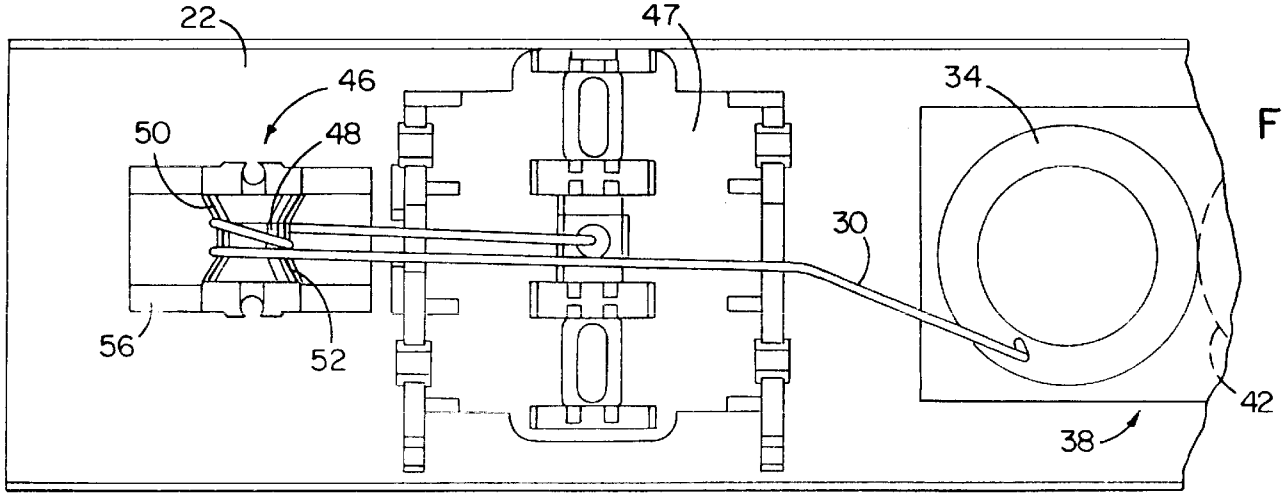
FIG. 3 is an enlarged fragmentary view of FIG.1.

Referring now to FIGS. 2 and 3, the spring motor 38 is shown positioned between the first and second cord spools 34 and 36. The cord spools 34 and 36 are intermeshed, as through gears, with the take-up drum 40 and drive drum 42 such that rotation of the cord spools 34 and 36 causes rotation of the drive drum 42 and take-up drum 40, and thus winding or unwinding motion in the spring member 44.

For example, when the blind 20 is moved from the retracted position to the extended position, the bottom rail 24 is pulled away from the head rail 22. This in turn pulls the first and second take-up cords 30 and 32 away from the head rail and causes the cord spools 34 and 36 to rotate. The rotation of the first and second cord spools 34 and 36 in turn causes the drive drum 42 to rotate and thus back wind a spring member from the take-up drum 40 to the drive drum 42. The take-up drum 40 is independently mounted such that rotation of the first and second cord spools 34 and 36 does not directly cause rotation of the take-up drum 40.

Thus, by pulling the bottom rail 24 downwardly away from the head rail 22, a spring member 44 is back wound onto the drive drum 42 creating biasing force tending to cause the spring member 44 to wind back onto the take-up drum 40 and thus pull the bottom rail toward the head rail. By appropriately sizing the width, thickness and or diameter of the spring member 44, this biasing force can be graded such that it is greatest when the bottom rail is fully retracted, and least when the bottom rail is fully extended. Otherwise, if a constant spring force member 44 is utilized, a mechanical locking or clamp mechanism must be utilized.

In order to ensure that a spring member 44 does not cause unwanted motion in the blind 20, additional friction is added to the system by the present invention by various forms of variable friction mechanisms or retarders. In the description that follows in correspondence to FIGS. 4–14 the various embodiments are depicted to show multiple ways in which friction can be added to the system during one direction of motion of the blind 20, and not in the opposite direction. However, it is to be understood that these embodiments are listed by way of example only, and not exclusive.

Figure 4:
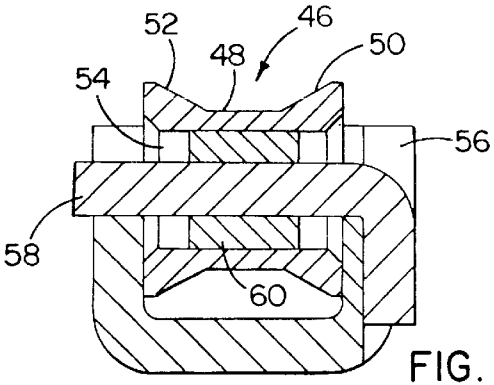
FIG. 4 is a sectional view taken along line 4—4 of FIG. 3.

First with regard to FIGS. 2–4, the first take-up 30 cord 30 is shown extending from the first cord spool 34 and wrapped around a capstan 46. The take-up cord 30 extends backward in the direction of the first cord spool 34 and then downwardly through a cord assembly 47 mounted to the head rail 22. The capstan 46 includes a cylindrical hub 48 with first and second tapered or frusto-conical sections 50 and 52. The capstan 46 also includes a through hole 54 about which the capstan 46 is able to rotate. As shown in FIG. 4, the capstan 46 is mounted to a frame 56 by an axle 58 and a bearing 60. A second capstan 46 is similarly provided for the second cord 32.

The bearing 60 is a one-way style of bearing in that it freely rotates in a first direction (clockwise or counterclockwise), but which resists rotation in the opposite direction. By wrapping the first take-up cord 30 around the capstan 46 and providing the one-way bearing 60 in an orientation which freely rotates with the cord 30 when the bottom rail 24 is pulled from the head rail 22, the capstan 46 will necessarily resist rotation in the opposite direction. This means that friction will be introduced by the one-way bearing 60 when the bottom rail 24 is moved toward the head rail 22. Since the capstan 46 will not rotate, the frictional drag between the first take-up cord 30 and the cylindrical hub 48 of the capstan 46 will slow movement of the first take-up cord 30 and thus movement of the blind 20.

Figure 5:
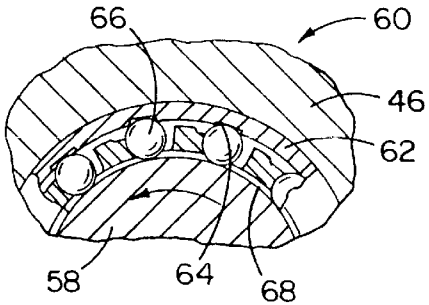
FIG. 5 is a sectional view of one embodiment of a one-way bearing according to the invention.
Figure 6:
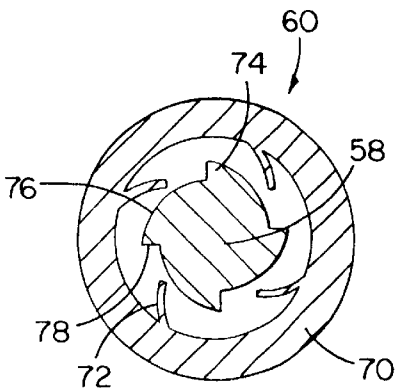
FIG. 6 is a sectional view of a second embodiment of a one-way bearing according to the invention.

FIGS. 5 and 6 show two embodiments of one-way bearings which may be utilized by the invention. However, again, such embodiments are by way of example only, and are not exclusive. Referring first to FIG. 5, the one-way bearing 60 is shown to have an outer race 62 having a plurality of locking ramps 64 corresponding in number to the number of balls 66 journalled within an inner race 68. The outer race 62 is frictionally engaged within the through hole 54 of the capstan 46 such that relative rotation between the outer race 62 and the capstan 46 is not possible. If the capstan 46 is rotated in a clockwise direction as depicted in FIG. 5, the balls 66 rotate clockwise as well, while the axle 58 is stationary. If the capstan 46 attempts to rotate counterclockwise, the balls 66 are frictionally engaged by the locking ramps 64 to prevent such rotation.

With regard to FIG. 6, another type of one-way bearing 60 is shown. The bearing 60 includes an outer race 70 frictionally engaged within the through hole 54 of the capstan 46. A plurality of locking tabs 72 radially extend inwardly from the outer race 70. The axle 58 shown in FIG. 6 is stationary, but includes a star shape in cross-section formed by a plurality of cam surfaces 74 extending radially outwardly therefrom. More specifically, each cam surface 74 includes an arcuate portion 76 and a locking shoulder 78. When the capstan 46 and outer race 70 rotate in a clockwise direction, the arcuate portions 76 engage the flexible locking tabs 72 by pushing the locking tabs 72 outwardly and allowing the capstan 46 to rotate. However, when the capstan 46 and outer race 70 attempt to rotate clockwise, the locking tabs 72 engage the locking shoulders 78, and prevent rotation.

Figure 7:
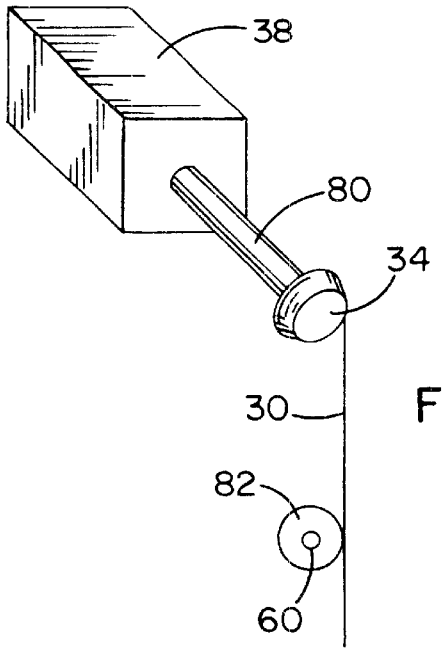
FIG. 7 is a schematic representation of a second embodiment of the invention.

FIG. 7 shows a second embodiment of the invention wherein the cord spool 34 is not linearly aligned with the spring motor 38, but rather is connected to a rotating shaft 80 extending from the spring motor 38. A roller 82 is provided downstream of the cord spool 34 and is mounted on a one-way bearing 60. The roller 82 is allowed to rotate in a clockwise direction, but not in a counterclockwise direction.

Figure 8:
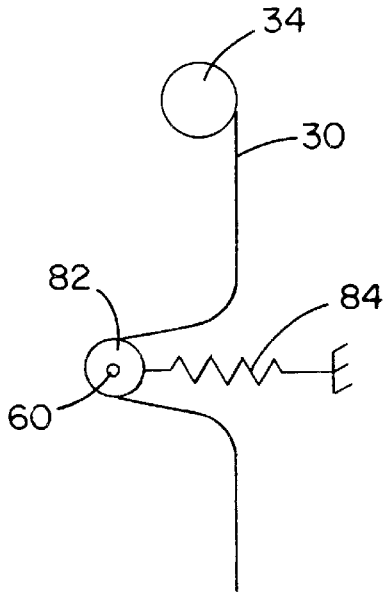
FIG. 8 is a schematic representation of a third embodiment of the invention.

FIG. 8 is a schematic representation of a third embodiment of the invention wherein the roller 82 is mounted onto a tension spring 84. Again, the roller 82 is downstream of the cord spool 34, and the roller 82 is mounted on to a one-way bearing 60. The tension spring 84 adds additional friction to the movement of the take-up cord 30.

Figure 9:
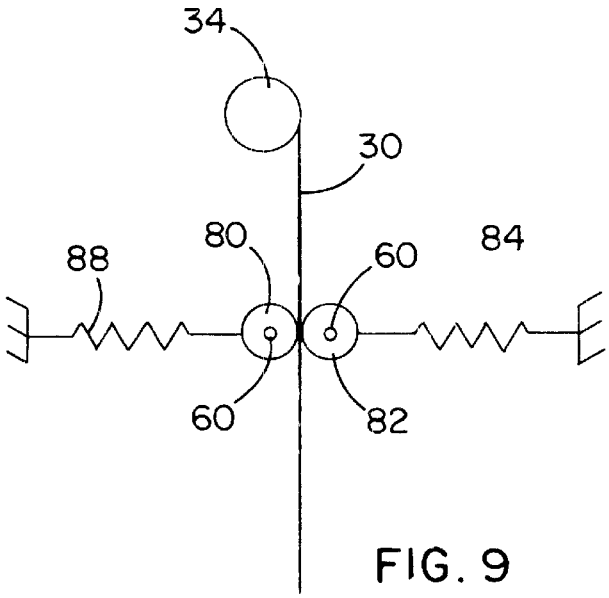
FIG. 9 is a schematic representation of a fourth embodiment of the invention.

FIG. 9 is a schematic representation of a fourth embodiment of the invention wherein the second roller 86 mounted on a second tension spring 88 is disposed so as to oppose the first roller 82. The first and second rollers 82 and 86 are downstream of the cord spool 34 and are mounted on one-way bearings 60. First and second tension springs 84 and 88 pinch the cord between the first and second rollers 82 and 86 to add additional friction to the movement of the take-up cord 30.

Figure 10:
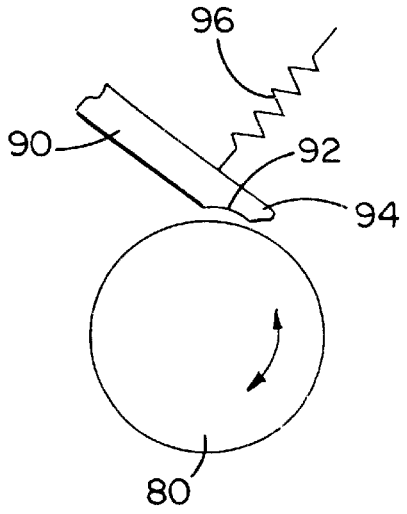
FIG. 10 is a schematic representation of a fifth embodiment of the invention.
Figure 11:
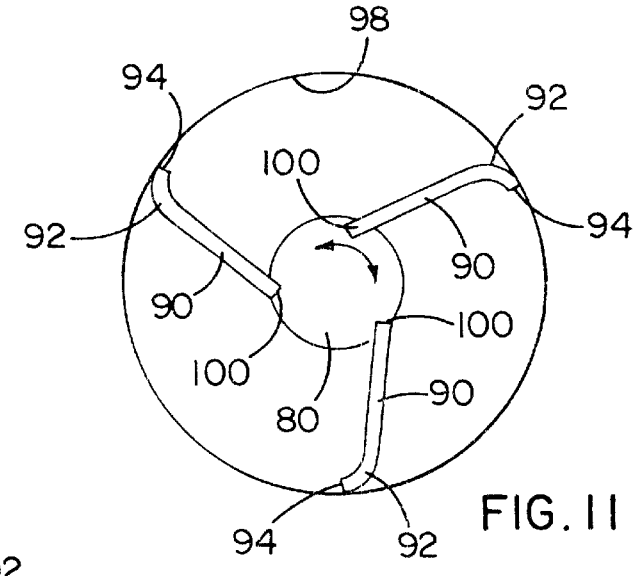
FIG. 11 is a schematic representation of a sixth embodiment of the invention.

FIGS. 10 and 11 show fifth and sixth embodiments wherein resistance is added to the rotation of the shaft 80, as opposed to the take-up cord 30. More specifically, in FIG. 10, a brake arm 90 is disposed at an angle to the shaft 80. The brake arm 90 includes a cam surface 92 and a braking surface 94. The brake arm 90 is biased into engagement with the shaft 80 by a tension spring 96. When the shaft 80 rotates in a clockwise direction as shown in FIG. 10, the shaft 80 engages the cam surface 92 which pushes the brake arm 90 away, against the force of the tension spring 96. However, when the shaft 80 attempts to rotate in a counterclockwise direction, as shown in FIG. 10, the tension spring 96 forces the braking surface 94 into engagement with the shaft 80 and thus resists rotation.

FIG. 11 is similar to FIG. 10 in that a brake arm 90 is utilized, however the embodiment of FIG. 11 includes three brake arms 90, all of which are mounted to the shaft 80. In addition, the shaft 80 and brake arms 90 are mounted within a cylinder 98. The brake arms 90 are pivotally attached to the shaft 80 at pivots 100 such that rotation of the shaft 80, in a counterclockwise direction, will cause the cam surfaces 92 to engage the cylinder 98 and force the brake arms 90 radially inwardly toward the shaft 80. As a result, rotation of the shaft 80 will not be impeded. However, if the shaft 80 attempts to rotate in a clockwise direction, the brake surfaces 94 of the brake arms 90 engage the cylinder 98 and resist rotation of the shaft 80.

Figure 12:
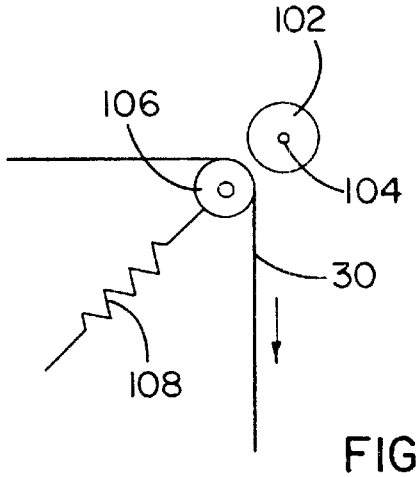
FIG. 12 is a schematic representation of a seventh embodiment of the invention.

FIG. 12 depicts a seventh embodiment of the invention wherein a first roller 102, having a fixed pivot 104, is provided adjacent a second roller 106 mounted on a tension spring 108. The take-up cord 30 is trained around the second roller 106 between the first roller 102 and second roller 106. If the take-up cord 30 is pulled downwardly, the tension spring 108 compresses, moving the cord 30 out of engagement with the first roller 102. The first roller 102 is thereby able to rotate with little friction being added to the motion of the take-up cord 30. However, when the take-up cord 30 attempts to move upwardly, the tension spring 108 forces the take-up cord 30 into pinching engagement between the first and second rollers 102 and 106, thereby adding friction and drag to the movement of the take-up cord 30.

Figure 13:
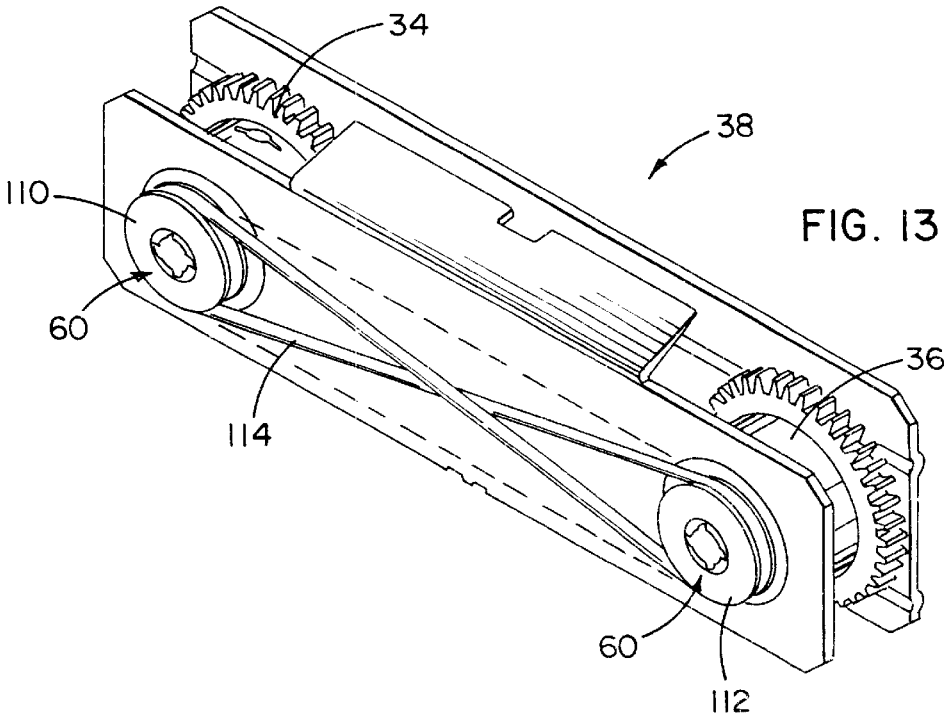
FIG. 13 is a schematic representation of an eighth embodiment of the invention.
Figure 14:
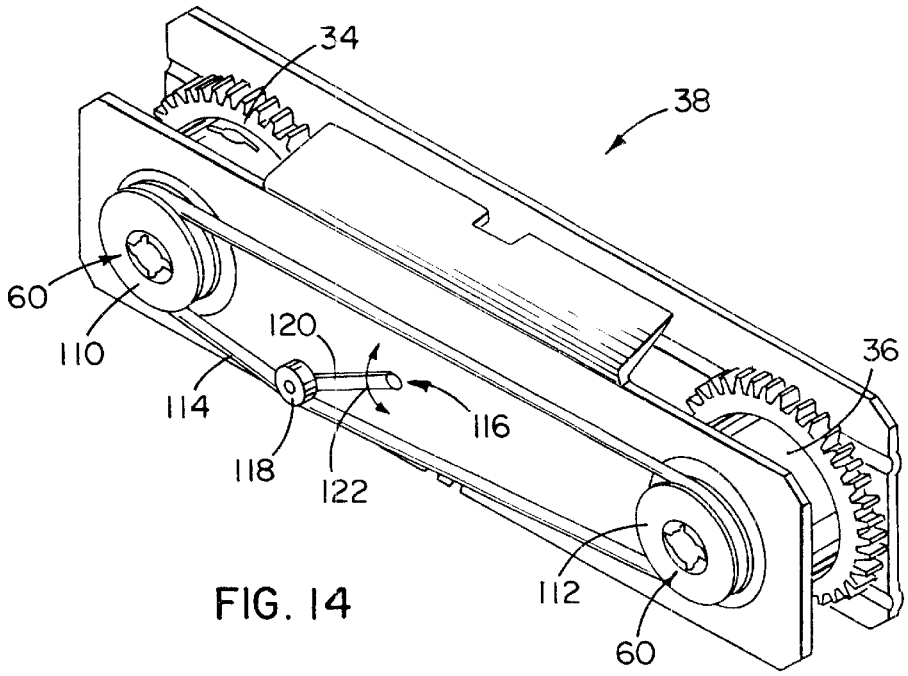
FIG. 14 is a schematic representation of a ninth embodiment of the invention.

FIGS. 13 and 14 depict eighth and ninth embodiments of the invention wherein first and second pulleys 110 and 112 are mounted outside the spring motor 38 with a belt 114 being trained around the first and second pulleys 110 and 112.

In FIG. 13, the first and second pulleys are mounted concentric with the first and second cord spools 34 and 36 with the first pulley 110 being mounted onto a one-way bearing 60. It is to be understood that, alternatively, the second pulley 112 could be mounted on a one-way bearing. As a result, rotation of the cord spools in one direction is not impeded by the one-way bearing 60, whereas rotation of the cord spools 34 and 36 in the opposite direction is impeded by the one-way bearing 60.

FIG. 14 is similar to FIG. 13 but for the addition of a belt tension adjustment mechanism 116. The belt tension adjustment mechanism 116 is provided in a form of a roller 118 mounted to a pivot arm 120. As can be appreciated from FIG. 14, the roller 118 is able to travel an arcuate pathway 122 as the pivot arm 120 pivots about arcuate pathway 122. In so doing, the diameter of the belt 114 can be increased or decreased and thus increase or decrease the tension within the belt 114. The belt tension adjustment mechanism 116 adds a constant amount of friction to the belt 114 regardless of the direction of rotation of the belt 114. As a result, at least one of the pulleys 110 and 112 is mounted on a one-way bearing 60.

From the foregoing, it can therefore be seen that the invention provides a spring motor, and window blind driven by a spring motor, with a mechanism for adding resistance to rotation of the spring motor in one direction and not the opposite direction.

What is claimed is:

1. A window shade, comprising:

an expandable covering, the covering being movable in a first direction when expanding to cover a window, the covering being movable in a second direction when retracting away from the window;

a variable force spring motor operably connected to the expandable covering to move the covering in the second direction; and a rotating output connected to the spring motor;

a retarder associated with the rotating output, the retarder introducing resistance to movement of, without locking, the covering in the second direction while not introducing resistance to movement of the covering in the first direction.

2. The window shade of claim 1 wherein the retarder includes a one-way bearing.

3. The window shade of claim 1 wherein the rotating output is a shaft, and the retarder includes a brake arm having a cam surface and a braking surface.

4. The window shade of claim 3 wherein the cam surface pushes the brake arm away from the shaft when the shaft rotates in a first direction, the braking surface frictionally engages the shaft when the shaft rotates in a second, opposite, direction, the shaft rotating in the first direction when the expandable covering moves in the first direction, the shaft rotating in the second direction when the expandable covering moves in the second direction.

5. The window shade of claim 3 wherein the brake arm is pivotally mounted to the shaft and the retarder further includes a cylinder surrounding the shaft, the cam surface pushing the brake arm away from the cylinder when the shaft rotates in a first direction, the braking surface frictionally engaging the cylinder when the shaft rotates in a second, opposite direction, the shaft rotating in the first direction when the expandable covering moves in the first direction, the shaft rotating in the second direction when the expandable covering moves in the second direction.

6. The window shade of claim 2 further including first and second pulleys operatively connected to the spring motor and a belt trained about the first and second pulleys, at least one of the pulleys being mounted on a one-way bearing.

7. A blind, comprising:

an expandable covering, the covering being movable in a first direction when expanding and in a second direction when retracting;

a cord connected to the expandable covering, the cord being movable in a first direction when the covering is retracted and in a second direction when the covering is expanded;

a spring motor connected to the cord for moving the covering between the retracted position and the expanded position; and a one-way roller in engagement with the cord for adding resistance to the movement of the cord in the first direction.

8. The blind of claim 7 wherein the one-way roller includes a capstan, the cord being wrapped around the capstan, the capstan being rotatable with the cord when the cord is moved in the second direction, the capstan resisting rotation when the cord is moved in the first direction.

9. The blind of claim 8 wherein the capstan is mounted onto a one-way bearing.

10. The blind of claim 7 wherein the one-way roller includes a roller biased against the cord, the roller being rotatable with the cord when the cord is moved in the second direction, the roller resisting rotation when the cord is moved in the first direction.

11. The blind of claim 10 wherein the roller is biased against the roller by a spring.

12. The blind of claim 10 wherein the roller is mounted onto a one-way bearing.

13. The blind of claim 10 further including a second roller biased against the cord, the first and second rollers being biased toward one another.

14. A blind, comprising:

an expandable covering, the covering being movable in a first direction when expanding and in a second direction when retracting;

a cord connected to the expandable covering;

a cord spool connected to the cord, a variable force spring motor connected to the cord spool by a rotatable shaft; and a brake adapted to exert a first force against the shaft when the expandable covering moves in the first direction, and a second, higher, force when the expandable covering moves in the second direction.

15. The blind of claim 14 wherein the brake arm includes a cam surface and a braking surface, the cam surface pushing the brake arm away from the shaft when the expandable covering moves in the first direction, the braking surface frictionally engaging the shaft when the expandable covering moves in the second direction.

16. The blind of claim 14 wherein the brake arm is pivotally mounted to the shaft and includes a cam surface and a braking surface and the blind includes a cylinder surrounding the shaft, the cam surface pushing the brake arm away from the cylinder when the expandable covering moves in the first direction, the braking surface frictionally engaging the cylinder when the expandable covering moves in the second direction.

17. A variable force spring motor assembly comprising:

a frame;

a take-up drum pivotally mounted to the frame;

a drive drum pivotally mounted to the frame;

a coil spring interconnected between the take-up drum and the drive drum;

a rotating member operatively connected to the drive drum; and a retarder associated with the rotating member, the retarder introducing resistance to, without locking, the rotating member in a first direction of rotation and not in a second direction of rotation.

18. The spring motor assembly of claim 17 wherein the rotating member is a cord spool having a cord extending therefrom.

19. The spring motor assembly of claim 17 wherein the rotating member is a shaft and the retarder includes at least one brake-arm.

20. The spring motor assembly of claim 19 wherein the brake arm is mounted at an angle to the shaft and includes a cam surface and a braking surface, the cam surface causing the brake arm to move away from the shaft when the shaft rotates in a first direction, the braking surface frictionally engaging the shaft when the shaft rotates in a second direction.

21. The spring motor assembly of claim 17 further including a pair of pulleys coupled to the rotating member and a belt trained around the pulleys, at least one of the pulleys being mounted on a one-way bearing.

22. A window shade, comprising:

an expandable covering, the covering being movable in a first direction when expanding to cover a window, the covering being movable in a second direction when retracting away from the window;

a spring motor operably connected to the expandable covering to move the covering in the second direction;

a rotating output connected to the spring motor;

a retarder associated with the rotating output, the retarder introducing resistance to movement of the covering in the second direction while not introducing resistance to movement of the covering in the first direction, wherein the retarder includes a one-way bearing;

at least one cord connected between the spring motor and the expandable covering; and a rolling member in engagement with the cord, the rolling member being mounted on the one-way bearing.

23. The window shade of claim 22 wherein the rolling member comprises a capstan, the cord being wrapped around the capstan at least once, the capstan and one-way bearing rotating with the cord when the expandable covering moves in the first direction, the capstan and one-way bearing not rotating when the expandable covering moves in the second direction.

24. The window shade of claim 22 wherein the rolling member comprises a roller mounted on a spring, the roller exerting tension on the cord and rotating with the cord when the expandable covering moves in the first direction, the roller not rotating with the cord when the expandable covering moves in the second direction.

25. The window shade of claim 24 further including a second roller mounted on a second spring, the first and second rollers pinching the cord therebetween.

26. A window shade, comprising:

an expandable covering, the covering being movable in a first direction when expanding to cover a window, the covering being movable in a second direction when retracting away from the window;

a spring motor operably connected to the expandable covering to move the covering in the second direction;

a rotating output connected to the spring motor; and a retarder associated with the rotating output, the retarder introducing resistance to movement of the covering in the second direction while not introducing resistance to movement of the covering in the first direction, wherein the retarder includes a first roller having a fixed pivot, and a second roller biased toward the first roller by a spring, and the window shade further includes a cord interconnected between the spring motor and the expandable covering, the cord being trained around the second roller, the spring compressing and the second roller moving away from the first roller when the expandable covering moves in a first direction, the spring forcing the cord against the first roller when the expandable covering is moved in the second direction.

27. A window shade, comprising:

an expandable covering, the covering being movable in a first direction when expanding to cover a window, the covering being movable in a second direction when retracting away from the window;

a spring motor operably connected to the expandable covering to move the covering in the second direction;

a rotating output connected to the spring motor;

a retarder associated with the rotating output, the retarder introducing resistance to movement of the covering in the second direction while not introducing resistance to movement of the covering in the first direction, wherein the retarder includes a one-way bearing;

first and second pulleys operatively connected to the spring motor and a belt trained about the first and second pulleys, at least one of the pulleys being mounted on the one-way bearing; and a belt tension roller in the engagement with the belt, the belt tension roller being movable to expand or contract the diameter of the belt.

28. A spring motor assembly comprising:

a frame;

a take-up drum pivotally mounted to the frame;

a drive drum pivotally mounted to the frame;

a coil spring interconnected between the take-up drum and the drive drum;

a rotating member operatively connected to the drive drum; and a retarder associated with the rotating member, the retarder introducing resistance to the rotating member in a first direction of rotation and not in a second direction of rotation, wherein the rotating member is a cord spool having a cord extending therefrom, and wherein the retarder is a capstan mounted onto a one-way bearing, the cord being wrapped around the capstan.

29. A spring motor assembly comprising:

a frame;

a take-up drum pivotally mounted to the frame;

a drive drum pivotally mounted to the frame;

a coil spring interconnected between the take-up drum and the drive drum;

a rotating member operatively connected to the drive drum; and a retarder associated with the rotating member, the retarder introducing resistance to the rotating member in a first direction of rotation and not in a second direction of rotation, wherein the rotating member is a cord spool having a cord extending therefrom, and wherein the retarder is a roller mounted onto a one-way bearing, the cord being wrapped around the roller.

30. The spring motor assembly of claim 29 wherein the roller is mounted on a tension spring.

31. The spring motor assembly of claim 30 further including a second roller mounted to a tension spring, the second roller opposing the first roller.

32. A spring motor assembly comprising:

a frame;

a take-up drum pivotally mounted to the frame;

a drive drum pivotally mounted to the frame;

a coil spring interconnected between the take-up drum and the drive drum;

a rotating member operatively connected to the drive drum;

a retarder associated with the rotating member, the retarder introducing resistance to the rotating member in a first direction of rotation and not in a second direction of rotation; and three brake arms pivotally mounted to and radially extending from the shaft and a cylinder surrounding the shaft and brake arms, each brake arm including a cam surface and a braking surface, the cam surfaces causing the brake arms to slide past the cylinder when the shaft is rotated in a first direction, the brake surfaces frictionally engaging the cylinder when the cylinder moves in a second direction, wherein the rotating member is a shaft and the retarder includes at least one brake-arm.

33. A spring motor assembly comprising:

a frame;

a take-up drum pivotally mounted to the frame;

a drive drum pivotally mounted to the frame;

a coil spring interconnected between the take-up drum and the drive drum;

a rotating member operatively connected to the drive drum;

a retarder associated with the rotating member, the retarder introducing resistance to the rotating member in a first direction of rotation and not in a second direction of rotation;

a pair of pulleys coupled to the rotating member and a belt trained around the pulleys, at least one of the pulleys being mounted on a one-way bearing; and a roller mounted to a pivot bar, the roller in engagement with the belt, tension in the belt being adjusted by movement of the pivot bar.

* * * * *